United States Patent [19]

Gallagher

[11] 4,164,636

[45] Aug. 14, 1979

[54] INTEGRAL ELECTRICAL SHORTING SWITCH AND CONNECTOR ASSEMBLY

[75] Inventor: David A. Gallagher, Romeoville, Ill.

[73] Assignee: Bunker Ramo Corporation, Oak Brook, Ill.

[21] Appl. No.: 823,226

[22] Filed: Aug. 10, 1977

[51] Int. Cl.[2] ..... H01R 13/70

[52] U.S. Cl. ..... 200/51 R; 200/159 R; 339/60 R; 339/60 M

[58] Field of Search ..... 200/51.11, 51.12, 51.16, 200/51 R, 51.01, 153 J, 159 R, 50 B; 339/60 R, 60 N, 61 R, 61 M, 184

[56] References Cited

U.S. PATENT DOCUMENTS

| | | | |
|---|---|---|---|
| 3,029,407 | 4/1962 | Burton et al. | 339/60 M |
| 3,209,109 | 9/1965 | Happe | 200/159 R |
| 3,300,600 | 1/1967 | Blomquist et al. | 200/159 R |
| 3,760,137 | 9/1973 | Shimojo et al. | 200/159 B |
| 3,880,487 | 4/1975 | Goodman et al. | 339/60 R |
| 3,936,124 | 2/1976 | Tuttle et al. | 339/60 M |
| 3,937,545 | 2/1976 | Cairns et al. | 339/60 R |
| 4,053,726 | 10/1977 | Schaad | 200/159 R |

FOREIGN PATENT DOCUMENTS

| | | | |
|---|---|---|---|
| 2601206 | 7/1977 | Fed. Rep. of Germany | 200/159 R |

*Primary Examiner*—Joseph Man-Fu Moy
*Attorney, Agent, or Firm*—William Lohff; F. M. Arbuckle

[57] ABSTRACT

An integral electrical shorting switch and connector assembly is disclosed having a pair of switch terminals each with a shorting end and an opposite contact end isolated from the environment. A conductive member for operatively shorting the switch terminals is mounted to a flexible, water-impervious boot surrounding and sealing the shorting end of the switch terminals, and a connector plug with contacts forms two interference fit seals at the contact end of the switch terminals.

4 Claims, 6 Drawing Figures

INTEGRAL ELECTRICAL SHORTING SWITCH AND CONNECTOR ASSEMBLY

BACKGROUND OF THE INVENTION

This invention relates generally to electrical switches of the shorting or ignition killing type and, more particularly, to an improved electrical switch and connector assembly in which the switch terminals and connections thereto are isolated from the environment to insure reliable switch operation.

Electrical switches of the type used for momentarily shorting a pair of conductors, such as those used in ignition to stop or kill an engine, are well known. Such switches are used for instance in lawn mowers or marine equipment and generally comprise two terminals, each having one end terminated by soldering or crimping to the respective ignition wires. The other ends of the switch terminals are spacially mounted a short distance apart so as to be selectively shorted by a movable conductor member when it is desired to turn off the associated engine. Under normal environmental conditions, such switches can be expected to operate reliabily. However, in high moisture conditions, such as encountered in marine equipment, water or other determintal substances often seep or otherwise find their way into the switch assembly and cause corrosion of the switch terminals. Since the terminals are generally enclosed, the corrosion may continue unnoticed, resulting in a condition where the switch terminals cannot be short circuited when desired by selective movement of the shorting member. Under severe situations, the corrosion may develop to such an extent that the switch terminals become intermittently or even permanently short circuited to cause unintended engine shut-off. In any event, the unreliable or inoperative switch must be replaced.

In addition to the unreliable or inoperative switch condition, a build-up of corrosion at the connector end of the switch terminals causes a weak point at the termination between the ignition wire and the switch terminal. Undesired breaking of the termination at the weak point may result from a combination of factors, including corrosion and the lack of adequate support for the ignition wires. In addition, equipment vibration encountered under normal operating conditions which rapidly degrade an already weakened termination to the breaking point.

SUMMARY OF THE INVENTION

The present invention is, therefore, directed to a shorting switch and connection assembly which overcomes the problems of the prior art relating to the seepage of water or other detrimental substances into the shorting switch. Thus, corrosion at the shorting portion of the switch terminals and also at the opposite termination portions of the switch is greatly reduced. Means are provided for sealing both ends of the switch terminals to isolate them from the environment. In addition, means are provided in the connector portion of the present invention so as to minimize the factors which previously contributed to the deterioration and breaking of the ignition wires at the termination point.

In accordance with one aspect of the present invention, an ignition kill switch is provided with a pair of elongated switch terminals mounted in a switch body, each terminal having a shorting portion end extending from the switch body so as to be surrounded and protected from the environment by an enclosure. The enclosure comprises a cavity formed in one end of the switch body covered by a conventional, flexible boot member, thereby isolating the shorting portion ends of the switch terminals in the cavity from the environment. A shorting conductor mounted in the boot projects into the cavity a short distance from the switch terminals so that deflection of the boot results in conductive engagement between the shorting conductor and the shorting portions of the switch terminals in the protected environment.

The switch terminals each further include a contact end which projects into an elongated recess in the switch body. The elongated recess is also sealed from the environment by a connector plug having mating contacts. The connector plug provides a primary seal exterior of the switch body and a secondary seal on the recess interior to protect and isolate the switch terminal contact ends from the environment. A conductor strain relief and double seal is also provided on each plug for the ignition wires. Thus, the present invention substantially eliminates the formation of destructive corrosion encountered with prior art shorting switches by reliably enclosing the contact of the switch within a uniquely configured, connectorized sealing member.

BRIEF DESCRIPTION OF THE DRAWINGS

The novel features which are believed to be characteristic of the invention are set forth in the appended claims. The invention itself, however, together with further object and attendent advantages thereof, will be best understood by reference to the following description taken in connection with the accompanying drawings in which:

DETAILED DESCRIPTION OF THE PREFERRED EMBODIMENTS

Figures 1, 2, 3, 4, 5, 6:
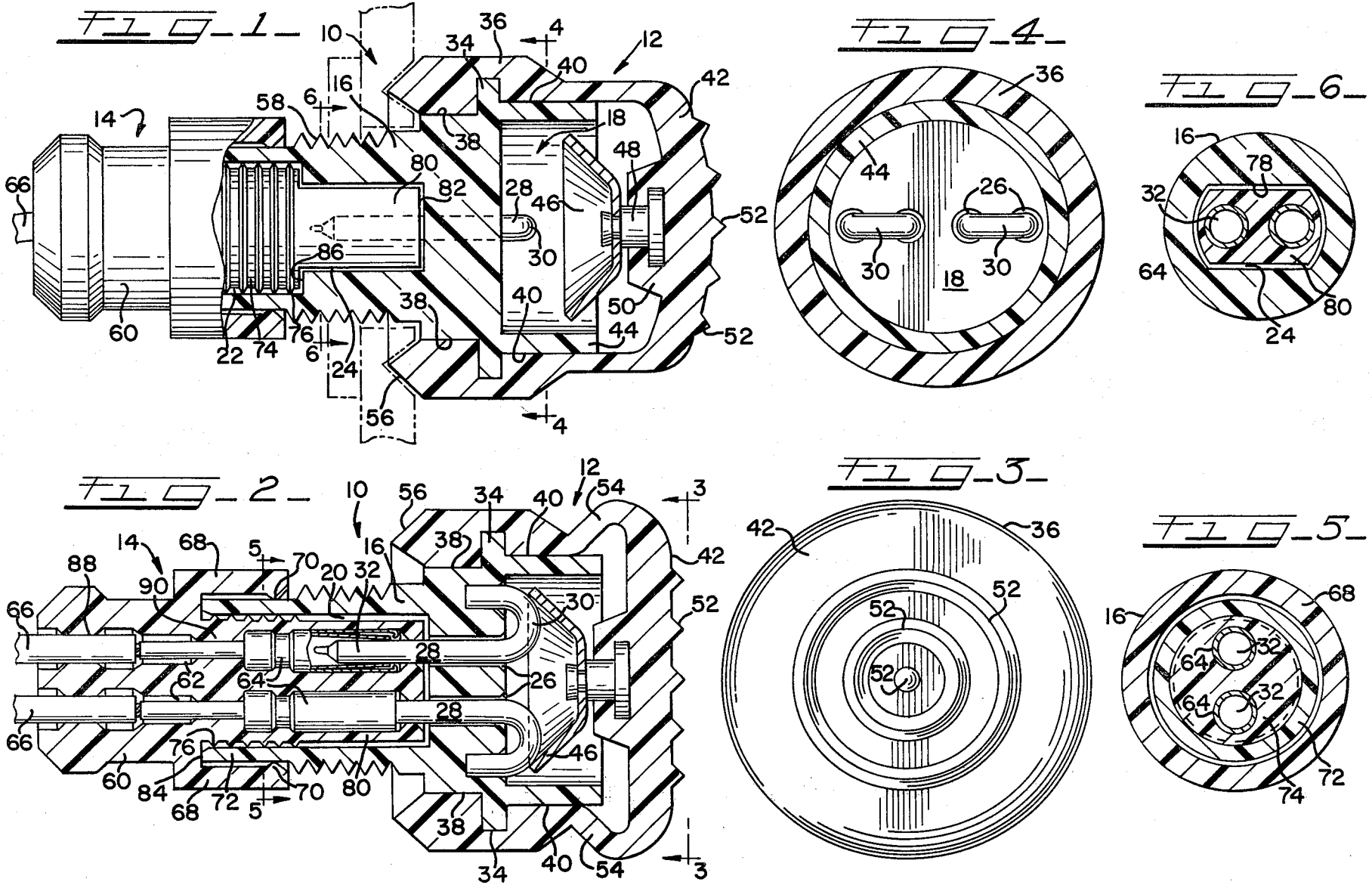
FIG. 1 is a partial sectional view illustrating an ignition shorting switch and connector assembly constructed in accordance with the principles of the present invention with the switch in the normal, non-shorting position.
FIG. 2 is a sectional view of the ignition shorting switch and connector assembly of FIG. 1 rotated 90° and illustrating a double-sealing boot member and a double-sealing connector plug environmentally protecting respective ends of the switch terminals, with the switch illustrated in the momentarily operated, shorting condition.
FIG. 3 is a side view of the switch and connector assembly shown in FIG. 2 taken along line 3—3 and showing the finger-actuated ridge portion of the boot.
FIG. 4 is a cross-sectional view taken along line 4—4 of FIG. 1, showing the respective shorting portion ends of the switch terminals.
FIG. 5 is a cross-sectional view taken along the line 5—5 of FIG. 2 showing an interference fit of the connector plug body and the switch body providing a double seal at the contact end of the switch terminals.
FIG. 6 is a cross-sectional view taken along line 6—6 of FIG. 1, showing details of the connector plug body and switch body construction enabling prealignment of the contacts and each respective member.

Referring now to FIGS. 1 and 2 of the drawings, there is illustrated an ignition shorting or killing switch and connector assembly 10 including a switch portion 12 and a connector portion 14 at each end thereof. The switch portion 12 includes a generally cylindrical switch body 16 having a cavity 18 and an elongated recess 20 formed in opposite ends thereof. As can be seen from FIG. 1, the longitudinal recess 20 comprises an outer, cylindrical recess portion 22 at one extreme end of the switch body and an inner recess portion 24.

The switch body 16 has two longitudinally or axially extending passageways such as 26 through which a respective elongated switch terminal 28 is inserted such as by press-fitting or well known ultrasonic welding means. Each of the switch terminals 28 includes a shorting portion 30 at one end which extends from the switch body in a hooked manner, reentrantly outwardly, shown best in FIG. 2, such that the very end thereof is press-fitted or ultrasonically inserted into the switch body. This hooked shape tends to stabilize the terminals during the switch operation. The other end of each switch terminal 28 comprises a male contact 32 which extends longitudinally into the switch body inner recess portion 24.

The switch portion 12 further includes a generally cylindrical flange 34 extending outwardly from and around the switch body to mate within a similarly shaped depression in the interior of a flexible boot member 36. As can be seen from FIG. 1, the boot 36 includes a sealing portion which is internally configured so as to sealingly engage the switch body. Thus, the shorting portions 30 of each of the switch terminals 28 is completely protected from moisture or other detrimental substances in the environment by being mounted in the cavity 18 such as to be completely surrounded by the switch body 16, the cavity wall 44 and the dome-like boot cap 42.

A bell-shaped shorting member 46 is mounted by means of a rivet 48 or other suitable member so as to project within the cavity 18 and thereby be protected from the environment by the boot. One end of the rivet 48 through conventional injection molding techniques may be captured within a protruding ridge 50 formed on the interior of the cap 42. The other end of rivet 48 passes through the shorting bell 46 and is enlarged in a known manner to lock the shorting bell in position.

The bell-shaped or curved shorting member 46 is formed of a conducting material, such as brass or copper, and is mounted in the cap 42 so that its center is substantially axially aligned between the longitudinally extending portions of the switch terminals 28. The interior of the shorting member is concave and dimensioned so as to overlie the hook-shaped shorting portions 30 of the switch terminals. Circular ridges and a central ridge 52 are preferably formed on the outer surface of the cap 42 to improve the friction characteristics of the cap facilitate operation of the switch.

In particular, shorting of the switch terminals 28 is accomplished by depressing the cap 42 and exerting an inward force sufficient to flex the cap 42 as shown in FIG. 2. The cap is momentarily depressed until the inner surfaces of the shorting bell 46 conductively engage each of the shorting portions 30. At that point, the associated engine stops running and the operator can release the pressure from cap 42 so that it flexes back to the non-shorting position shown in FIG. 1. It may be particularly noted that whereas the cap 42 flexes along a movable portion 54, the seals 38 and 40 are still maintained between the boot 36 and the switch body 16. The boot 36 is formed of a water-impervious, flexible material and can be conveniently formed of a flexible elastomeric material. The switch body 16 is preferably formed of dielectric thermoplastic.

The switch portion 12 may be conveniently mounted to a panel (shown in phantom lines), and, in preferred form, the front edge 56 of the boot may be beveled so as to fit within a similarly beveled or counter-sunk panel portion. The switch body 16 in this case further includes an externally threaded portion 58 such that after the switch portion 12 is inserted through a beveled panel aperture, with the beveled edge 56 of the boot nested in the panel, the switch can be mounted by threading a nut (shown in phantom lines) onto the threaded portion 58 to urge the beveled edge 56 in snug fitting and sealing engagement with the panel. It will be further appreciated that the boot 36 is captured between the panel on which the switch is mounted and flange 34, thereby positively clamping and sealing the boot with the switch body.

The connector portion 14 of the switch 10 includes a generally cylindrical connector plug body 60 having two longitudinally extending passageways 62 which receive respective elongated socket contacts 64 having tubular ends for receiving respective male contact ends 32 of the switch terminals. Each socket contact 64 may be of the hooded type having an outer sleeve with inner tines such that the tines are forceably spread apart so as to conductively engage the male contact 32. At the rear end of each of the contacts 64, an insulated conductor 66 is terminated by conventional soldering, crimping or insulation-piercing techniques. In this instance, the conductors 66 comprise the respective ignition wires coupled to an associated engine such that insertion of the connector portion 14 into the switch portion 12 electrically engages the conductors 66 with the respective switch terminals 28.

The connector plug body 60 includes a generally cylindrical skirt portion 68, having an inner protuberance or ridge 70 at its distal end with an inner diameter slightly less than the outer diameter of the recess wall 72 such that the skirt 68 may be interference-fit onto the switch body thereby providing mounting retention of the connector portion with the switch portion. This interference-fit between skirt 68 and the external surface of outer recess wall 62 also provides a primary seal to prevent moisture or other undesirable substances from finding their way into the outer recess 22 and inner recess 24 in the interior of the switch body.

A generally cylindrical portion 74 of plug body 60 is provided with a series of ridges 76, dimensioned so as to provide an interference-fit with the inner surface of recess wall 72. This provides a series of secondary mating seals between the connector plug body and the switch body to further prevent undesirable substances from eventually entering into the switch body and inner recess 24. Thus, the contact portions 32 of the switch terminals extending in switch body recess 20 are protected from the environment by the switch body recess walls and by the surrounding connector plug body with the primary seal 70 on the exterior of the recess and the sealing ridges 76 along the inside portion of the recess.

Means are also provided for pre-aligning the connector portion and the switch portion such that the primary and secondary connector seals do not engage the switch body until axial alignment of the socket contacts 64 and the switch terminal contact ends 32 has occurred. With reference to FIG. 6, the switch body recess 24 includes an inner wall surface 78 which is shaped so as to match the similarly shaped front portion 80 of the connector plug body 60. Thus, as the plug front extension 80 meets the inner recess 24, it must be properly oriented in order to obtain the alignment shown in FIG. 6. In addition, the length of the front portion 80 extending from the front ridge 76 to the leading edge 82 is preferably equal to or slightly greater than the longitudinal dimension of outer recess 22, i.e., the length of the switch body between its outer edge 84 and the step 86 at the beginning of inner recess 24. This dimensioning enables the front portion 80 of the connector to be readily oriented with inner recess 24 thus aligning the contacts, without having either the interference of ridges 76 or the protuberance 70 sealing onto the switch body. Once the proper alignment has been obtained, the socket contacts 64 may be mated with the contact ends 32 of the switch terminals by pushing the plug body axially into the switch portion, thereby forming the firm interference-fit previously described for both the primary and secondary mating seals both inside and outside of the longitudinal switch body recess 20.

The rear end of the connector plug body 60 further includes risers 88 and 90 extending inwardly from the passageways 62. The risers 88 provide a support or strain relief for the conductors 66 and an individual seal for each conductor, while risers 90 provide contact retention to prevent rearward axial displacement of the contact.

The connector plug body 60 is preferably formed of a flexible elastomeric material. Insertion of the socket contacts 64 into the passageways formed in plug body 60, may be provided with an appropriate insertion tool, such as that disclosed in copending application, U.S. Ser. No. 722,674, assigned to the same assignee as the present application.

It will be appreciated by those skilled in the art that the construction of the present invention provides a reliable and quick-release, connectorized switch assembly. The possibility of failure due to corrossion is greatly reduced, if not entirely eliminated. The termination of the conductor leads to the switch terminals is also enhanced due to the improved mechanical or structural support given to the leads. For example, vibration and slight physical distortion of the connector plug should not impair the quality of the connection.

Utilizing the principles of the invention, one may, if desired, reverse the male-female contacts described herein. Thus, female socket contacts rather than male contacts can be provided for contact portion 32 at the inner recess 24. The plug body would then include projecting male contacts rather than the socket contacts 64.

Of course, it should be understood that other changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A switch and connector assembly, comprising:

a switch body having a cavity formed in one end and a recess formed in the other mating end;

a plurality of switch terminals rigidly mounted in said switch body, each of said terminals including a respective switch portion extending into said cavity and a contact portion in or adjacent said recess, said switch recess having a plug orienting portion of non-circular cross-section remote from the mating end of said switch body and a cylindrical portion adjacent the mating end of said switch body and bounded by a cylindrical recess wall;

a flexible boot sealed to said switch body to isolate said switch portions of said switch terminals in said cavity from the environment, said boot supporting a conductive member to engage said switch portions during selective operation of said switch;

a connector plug having a plurality of contacts for mating with said contact portions of said switch terminals, said connector plug including a forward portion of non-circular cross-section complementary to the non-circular cross-sectional shape of said recess orienting portion for cooperative insertion within said recess orienting portion to facilitate mating of said plug and body and insure mating of said plug contacts with said contact portions of said switch terminals, and a rearward base portion dimensioned for cooperative insertion within said recess cylindrical portion;

said connector plug also including primary and secondary sealing means to isolate the interior of the mated connector assembly from the environment; said primary sealing means comprising a completely circumferential sealing lip engaging the exterior of said recess wall and said secondary sealing means comprising a plurality of completely circumferential sealing ridges engaging the interior of said recess wall;

said forward portion of said connector plug extending longitudinally beyond said primary and secondary sealing means to permit alignment within said recess orienting portion prior to engagement of said switch recess wall by said primary or secondary sealing means.

2. The switch and connector assembly of claim 1, wherein said primary sealing means further comprises a skirt radially spaced from said plug base portion, said skirt having said sealing lip integrally molded at its distal end.

3. The switch and connector assembly of claim 1, wherein said connector plug includes passageways for conductors connectable to said contacts in said plug, said passageways having circumferential protrusions to seal against said conductors.

4. The switch and connector assembly of claim 1, wherein said flexible boot is the sole supporting means for said conductive member for movement of the conductive member toward and away from said switch portions of said switch terminals.

* * * * *